US005813990A

United States Patent [19]

Ryll

[11] Patent Number: 5,813,990

[45] Date of Patent: Sep. 29, 1998

[54] PROJECTED DISPLAY SPORT GOGGLE

[76] Inventor: David Lloyd Ryll, 7670 S. Olive Cir., Englewood, Colo. 80112

[21] Appl. No.: 440,899

[22] Filed: May 15, 1995

[51] Int. Cl.[6] ..... A61B 5/02

[52] U.S. Cl. ..... 600/500; 351/41; 351/158; 2/422; 2/425; 2/426

[58] Field of Search ..... 128/687, 736, 128/782, 691, 863; 2/410, 422, 425; 351/43, 47, 158, 57

[56] References Cited

U.S. PATENT DOCUMENTS

| | | | |
|---|---|---|---|
| 4,796,987 | 1/1989 | Linden | 351/158 X |
| 5,001,786 | 3/1991 | Copeland | 2/410 X |
| 5,094,240 | 3/1992 | Muz | 128/687 X |
| 5,293,877 | 3/1994 | O'Hara et al. | 128/736 |
| 5,373,857 | 12/1994 | Travers et al. | 128/782 |
| 5,446,506 | 8/1995 | Dawkins, Jr. | 351/43 X |

*Primary Examiner*—Robert L. Nasser
*Assistant Examiner*—Ryan Carter
*Attorney, Agent, or Firm*—Patent Law Offices of Rick Martin, P.C.

[57] ABSTRACT

A projected display sport goggle that is used to provide continuous and uninterrupted feedback of information to the athlete. The goggle will permit the athlete to adjust their performance based on real time information. This information includes speed, distance traveled, temperature, heart rate, time of day, elapsed time, cadence, and a time based alarm. The informational display presented by the goggle is easy to read and understand. Similar in size and shape to a pair of eyeglasses, it will not significantly interfere with or restrict the movement of the athlete. It is capable of withstanding the impacts and shocks associated with athletic activities. It is easy to use and operate, and is inexpensive to manufacture. The goggle provides a safe, economic, and highly reliable method for monitoring an athlete's performance.

20 Claims, 14 Drawing Sheets

PROJECTED DISPLAY SPORT GOGGLE

BACKGROUND—FIELD OF INVENTION

This invention relates to the field of personal athletic activity monitoring devices, specifically to a head mounted personal athletic activity monitoring device.

BACKGROUND—DESCRIPTION OF PRIOR ART

Athletes engaged in activities such as skiing, bicycling, and running are continually seeking methods to monitor statistics related to their individual performance. These statistics typically include information related to speed, distance traveled, duration of activity, and heart rate.

As a result, a multitude of personal athletic activity monitoring devices have been proposed and are well known in the prior art. These devices typically use some type of electronic display and are frequently mounted on the wrist or are attached to various locations on the user's body. These types of devices suffer from a number of disadvantages:

(a) Most are unable to provide continuous, uninterrupted feedback of information to the athlete. The athlete must look directly at the device and shift their focus away from their activity.

(b) The lack of continuous feedback makes it difficult for the athlete to adjust their performance based on real time information.

(c) Many of the device's information displays are difficult to read and comprehend. This limitation often forces the athlete to stop their activity so that they can concentrate on the information display.

(d) The required distraction that is caused by looking at such a device may result in a loss of concentration and possible injury to the athlete.

(e) The operation of these devices is often unnecessarily complicated and difficult.

A head mounted projection display device would solve many of these limitations. Head mounted projection display device's are well known and have been applied to many other areas of prior art.

At the present time there is no known head mounted projection device that has been developed to support the exclusive requirements associated with a personal athletic activity monitoring device.

OBJECTS AND ADVANTAGES

Accordingly, besides the objects and advantages of the personal athletic activity monitoring device described above, several objects and advantages of the present invention are:

(a) to provide an athletic activity monitoring goggle that provides continuous and uninterrupted feedback of information to the athlete;

(b) to provide an athletic activity monitoring goggle which will allow an athlete to adjust their performance based on real time information;

(c) to provide an informational display that is simple to read and comprehend;

(d) to provide an athletic activity monitoring goggle that will minimize interference with the concentration, movement, and activity of the athlete; and (e) to provide an athletic activity monitoring goggle that is easy to use and operate.

Further objects and advantages are to provide an athletic activity monitoring goggle that is able to withstand the impacts and shocks associated with athletic activities, and to provide an athletic activity monitoring goggle that is inexpensive and simple to manufacture. Still further objects and advantages of my invention will become apparent from a consideration of the drawings and ensuing description.

DRAWING FIGURES

The invention, both as to organization and method of practice, together with other objects and advantages thereof, will best be understood by reference to the following description, taken in connection with the accompanying drawings, in which:

FIG. 1 is a front perspective view of the preferred embodiment of the athletic activity monitoring goggle, FIG. 2 is an exploded perspective view of the preferred embodiment of the goggle, FIG. 3 is a left side elevation of the preferred embodiment of the goggle, FIG. 4 is an exploded perspective view of the impeller used in the preferred embodiment, FIG. 5 is an exploded perspective view of the pulse sensor assembly, FIG. 6 is a circuit diagram illustrating in schematic form the electronic circuit used in the preferred embodiment of the goggle, FIG. 7 is a plan view of the electronic display illustrating the layout of segments, FIG. 8 is a mode diagram flow chart of the various operational modes and states provided by the circuit of FIG. 6, FIG. 9 is a mode diagram flow chart of the power/measurement sequence mode provided by the circuit of FIG. 6, FIG. 10 is an exploded perspective view of a second embodiment of the goggle, FIG. 11 is a circuit diagram illustrating in schematic form the electronic circuit used in the second embodiment of the goggle, FIG. 12 is a schematic diagram which shows a ray tracing of the optics of the preferred embodiment from a top elevation, FIG. 13 is a schematic diagram which shows a ray tracing of the optics of the preferred embodiment from a side elevation, and FIG. 14 is a view of the projected display reflecting on the goggle lens as seen from the eye of the user.

REFERENCE NUMERALS IN DRAWINGS

20 sports goggle
22 goggle lens
24 left ear piece
26 right ear piece
28 goggle casing cover
30 goggle casing base
32 air inlet
34 switch S1
36 switch S2
38 pulse sensor assembly
40 screw
42 battery
44 battery housing/PCB mount
46 ASIC controller unit

48 electronic display
50 impeller assembly
52 thermistor temperature sensor
54 PCB assembly
56 air stream
58 impeller fan
60 impeller case
62 permanent magnet
64 magnetic sensor switch
66 left ear clip
68 right ear clip
70 infrared phototransistor
72 infrared detector module
74 spring bar
76 clip connector wire
78 PCB connector wire
80 display bus
82 external capacitor C1
84 external capacitor C2
86 filter
88 external variable capacitor C3
90 external capacitor C4
92 quartz crystal
94 piezo electric crystal
96 inductance coil
98 drive transistor
100 upper level of digits
100*a* digit 1
100*b* digit 2
100*c* digit 3
100*d* digit 4
100*e* digit 5
100*f* digit 6
102 lower level of icons
102*a* speed icon
102*b* distance icon
102*c* temperature icon
102*d* heart rate icon
102*e* time icon
102*f* timer icon
102*g* cadence icon
102*h* alarm icon
104 operation mode sequence
106 speed mode
106*a* speed message state
106*b* speed display state
108 distance mode
108*a* distance message state
108*b* reset distance state
108*c* distance display state
110 temperature mode
110*a* temperature message state
110*b* temperature display state
112 heart rate mode
112*a* heart rate message state
112*b* heart rate display state
114 time mode
114*a* time message state
114*b* set time state
114*c* time display state
116 timer mode
116*a* timer message state
116*b* reset timer state
116*c* timer display state
118 cadence mode
118*a* cadence message state
118*b* cadence display state
120 alarm mode
120*a* alarm message state
120*b* set alarm state
120*c* alarm display state
122 power/measurement mode sequence
124 turn display on mode
126 metric measurement mode
128 English measurement mode
130 turn display off mode
132 mass airflow sensor
134 user's eye
136 radiant light wave
138 line of sight
140 projected image
142 reflected image

DESCRIPTION OF THE PREFERRED EMBODIMENTS

Figure 1:
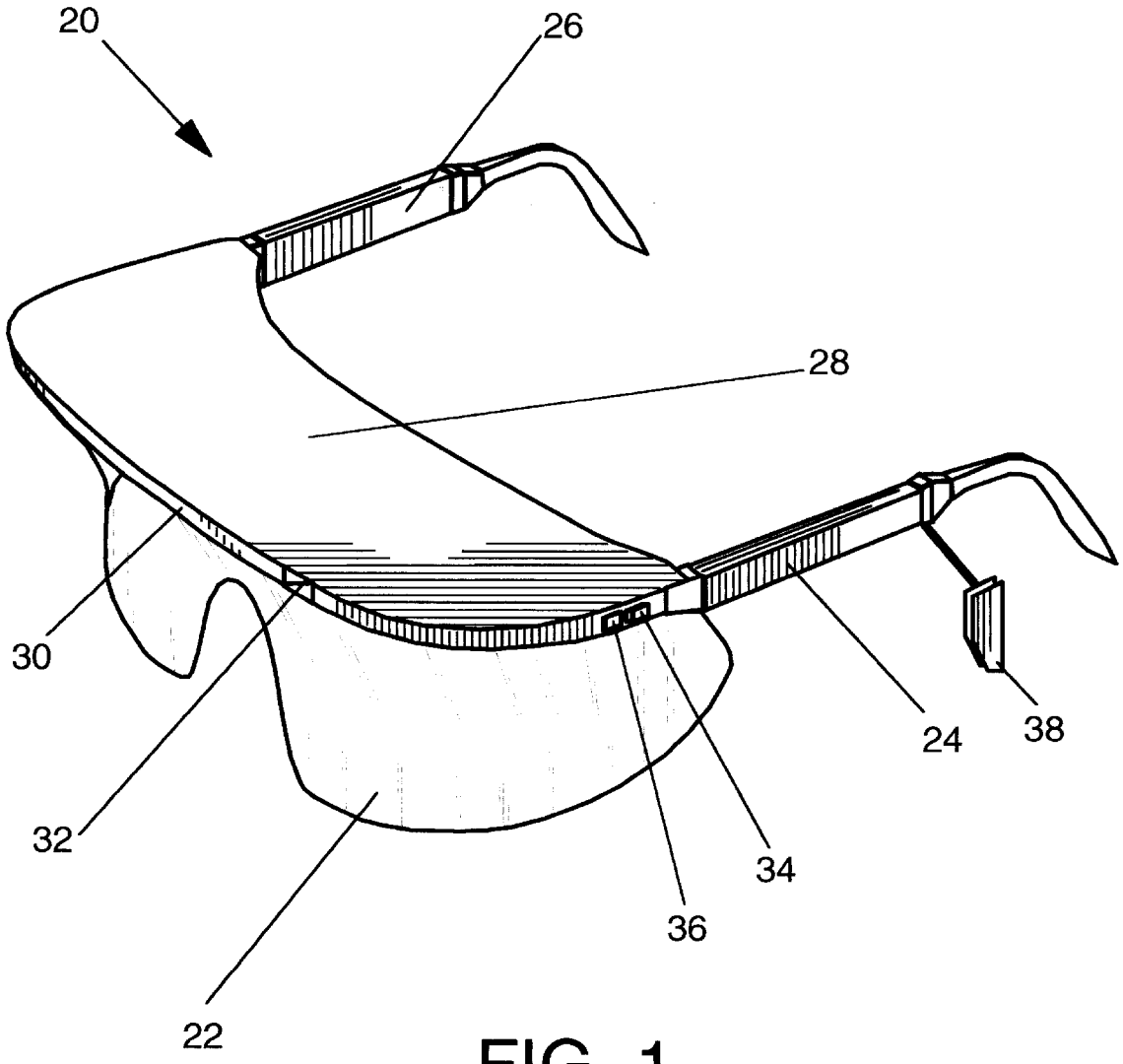
Figure 2:
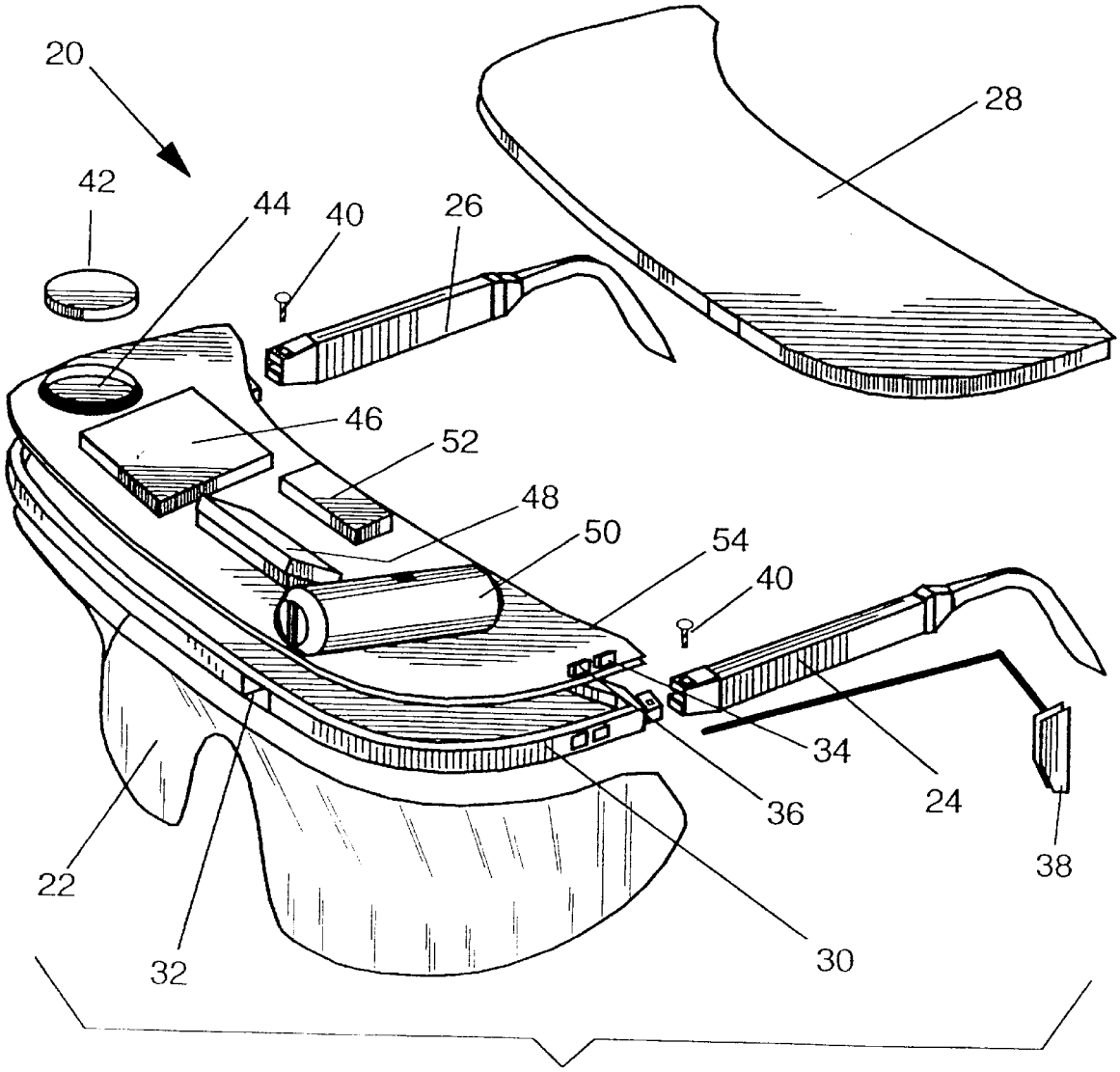

A preferred embodiment of a sports goggle 20 is illustrated in FIGS. 1 and 2 of the drawing. Sports goggle 20 has a transparent goggle lens 22 that is affixed to the underside of a goggle casing base 30 with a suitable adhesive. In the preferred embodiment, goggle lens 22 is constructed of a light-weight polycarbonite plastic, capable of partially reflecting radiant light waves.

A left ear piece 24 and a right ear piece 26 are connected to goggle casing base 30 with a screw 40. A goggle casing cover 28 is press-fit into the top of goggle casing base 30. A pulse sensor assembly 38 is attached to left ear piece 24, and is clipped to the ear lobe of the user. Pulse sensor assembly 38 is discussed in detail with reference to FIG. 5. In the preferred embodiment, left ear piece 24, right ear piece 26, goggle casing cover 28 and goggle casing base 30 are constructed of a light-weight impact-resistant plastic.

To create a goggle capable of withstanding the impacts and shocks associated with athletic activities, the overall philosophy and design concept considered the following:

Ability to withstand vibration;

Ability to withstand extremes of temperature;

Imperviousness to moisture;

Small size, light weight, and low profile;

Low power consumption for minimum battery size.

To achieve these goals, advantage has been taken of ASIC and SMD technology.

ASIC (Application Specific Integrated Circuits) allows the custom manufacture of complex circuitry in a small micro processor that is designed solely for the intended function, combining both digital and analog systems. The result is a highly efficient unit that acts as the onboard control center for the goggle based unit.

SMD (Surface Mount Device) refers to the way in which the printed circuit board is manufactured. Instead of conventional leaded components soldered onto a circuit board, SMD places the components directly onto the board which are then soldered in an infra red oven and subsequently protectively coated. This concept results in a small PCB (Printed Circuit Board) which is insensitive to moisture and vibration, is compact, and very economical to manufacture.

A PCB assembly 54 is press-fit inside of goggle casing base 30. Mounted on PCB assembly 54 is a battery housing/pcb mount 44, a switch S1 34, a switch S2 36, an ASIC controller unit 46, an electronic display 48, a thermistor temperature sensor 52, and an impeller assembly 50. Impeller assembly 50 is described in detail with reference to FIG. 4. An air inlet 32 in goggle casing base 30 allows air to pass into impeller assembly 50. Switch S1 34 and switch S2 36 both fit into openings in the side goggle casing base 30. A battery 42 is placed in battery housing/pcb mount 44.

Goggle casing base 30 and PCB assembly 54 have aligned openings that permit radiant light emitted by electronic display 48 to pass through into the inside of sports goggle 20. Preferably, electronic display 48 is a high brightness LED (light emitting diode) capable of emitting radiant light waves, providing a wide angle of visibility, and having low power requirements.

Figure 3:
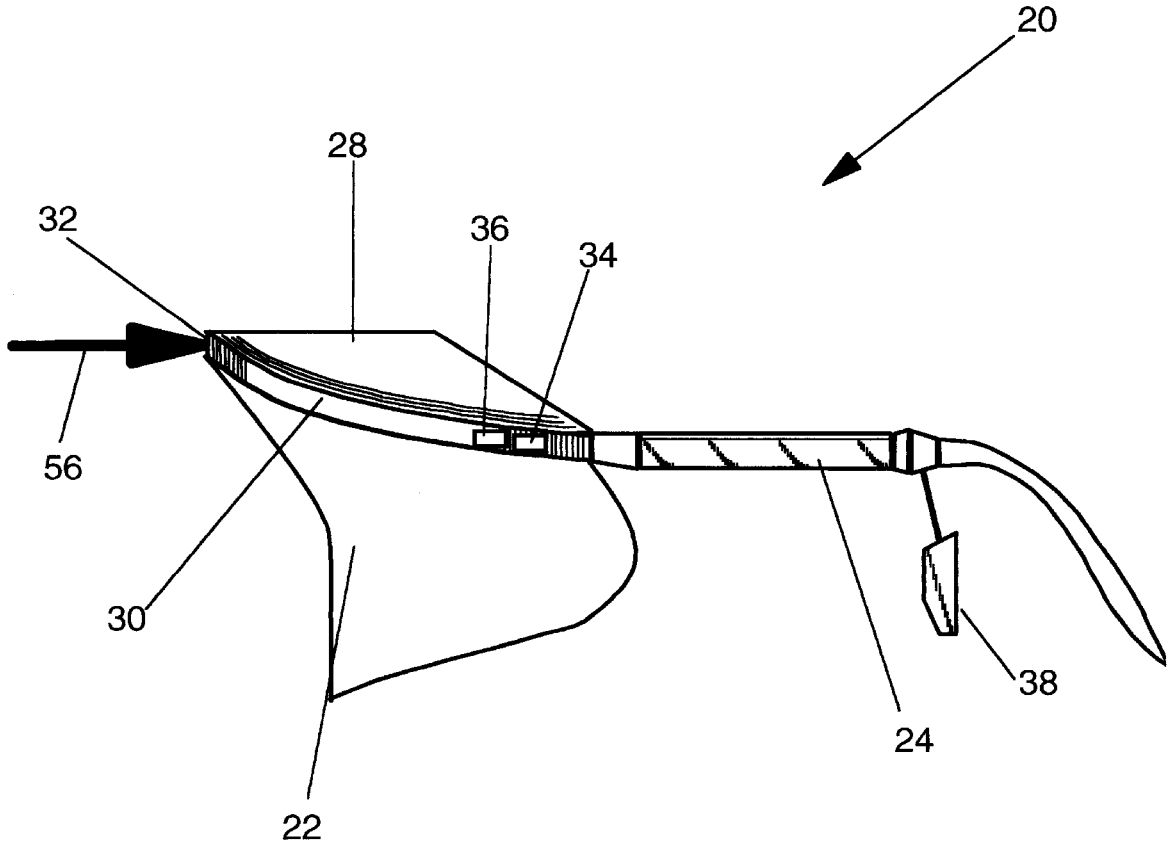

Referring now to FIG. 3, a left side profile of sports goggle 20 is seen. The top of goggle lens 22 is angled in an outward direction to facilitate the projection of an image on the inside surface of goggle lens 22. This projection of an image is described in detail with reference to FIG. 12 and FIG. 13. The flow of air into goggle air inlet 32 is represented by an air stream 56. Air stream 56 is created by air resistance as the user of sports goggle 20 moves in a forward direction.

Figure 4:
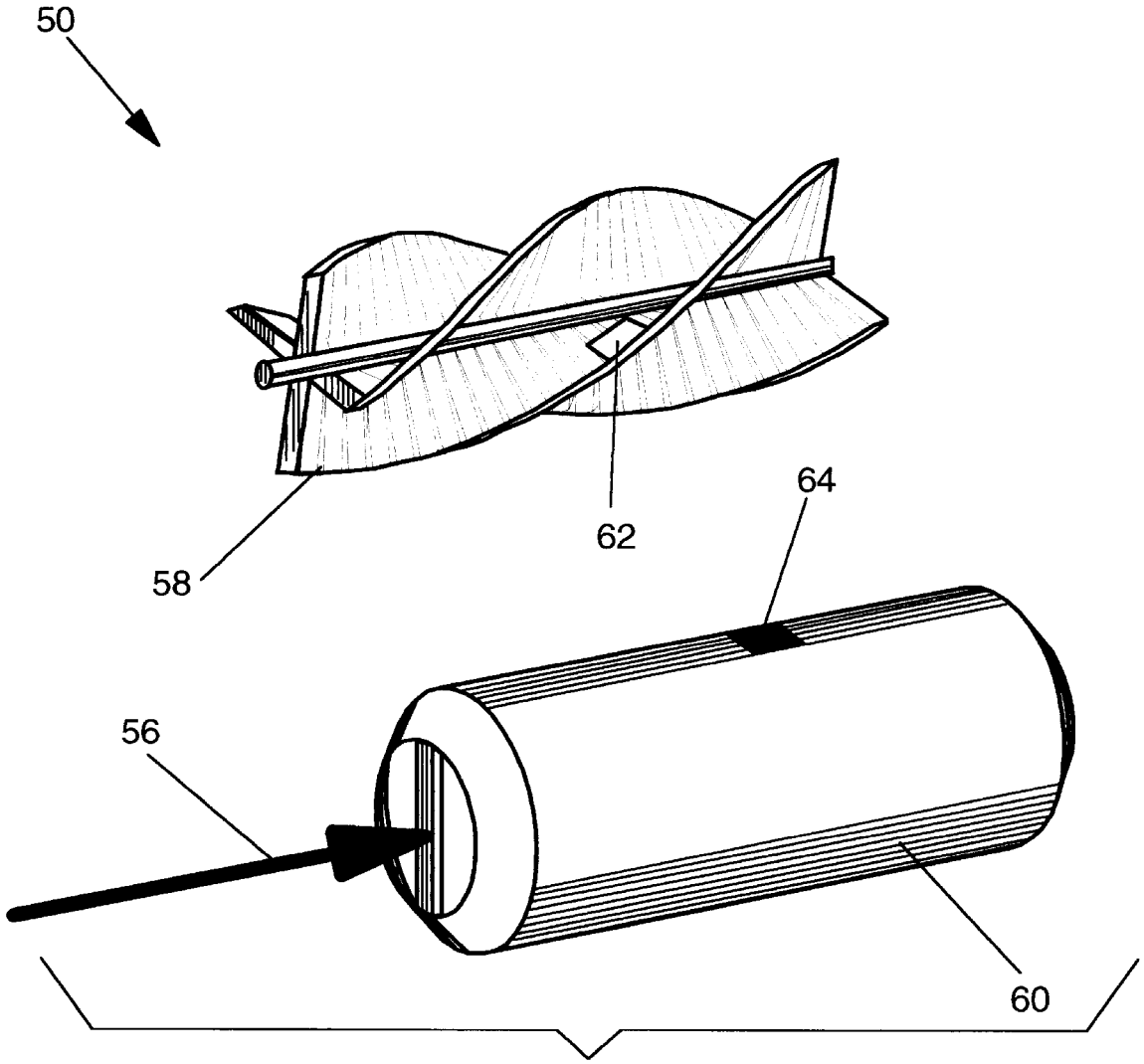

Referring now to FIG. 4, impeller assembly 50 is comprised of a freely rotating impeller fan 58, an impeller case 60, a permanent magnet 62 mounted on impeller fan 58, and a magnetic sensor switch 64 mounted on impeller case 60. Impeller fan 58 is rotatably mounted within impeller case 60, and is able to rotate freely.

Air stream 56 will cause impeller fan 58 to rotate on its axis. Magnetic sensor switch 64 is actuated during each revolution of impeller fan 58 by permanent magnet 62. Magnetic sensor switch 64 simply provides a switch closure and is preferably a magnetically responsive solid-state position sensor.

Figure 5:
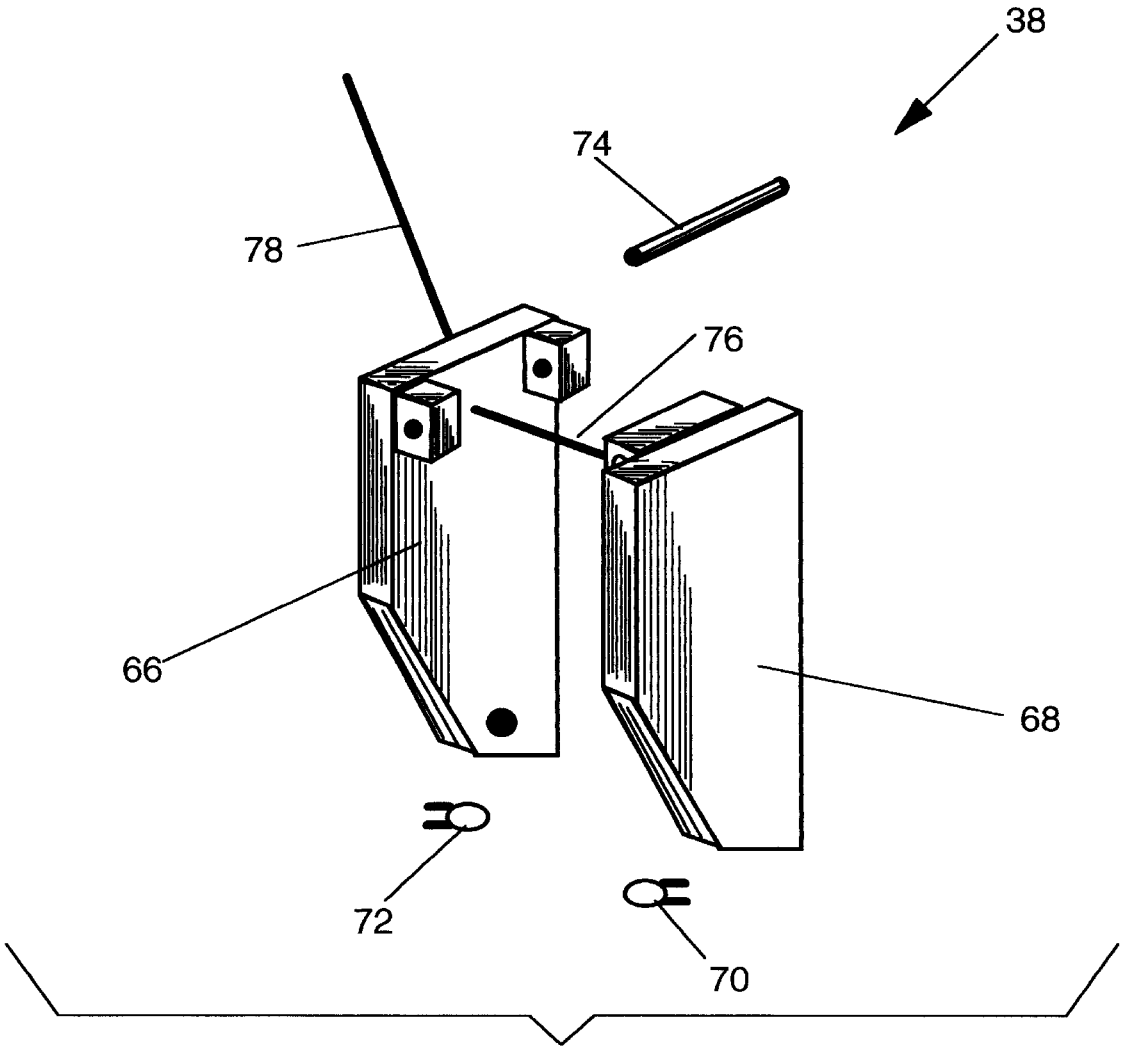

Referring now to FIG. 5, pulse sensor assembly 38 is comprised of a left ear clip 66, a right ear clip 68, a spring bar 74, an infrared phototransistor 72, an infrared detector module 70, a clip connector wire 76, and a PCB connector wire 78. Lugs on left ear clip 66 are connected to lugs on right ear clip 68 with spring bar 74. Infrared phototransistor 72 is mounted in left ear clip 66 and infrared detector module 70 is mounted in right ear clip 68.

Pulse sensor assembly 38 is clipped to the ear lobe of the user. The ear lobe is a relatively thin membrane that allows light to pass through easily. Infrared phototransistor 72 is aligned directly across from infrared detector module 70 in pulse sensor assembly 38. Infrared phototransistor 72 emits a constant infrared beam of light.

As blood pulses through the blood veins in the ear, the amount of infrared light allowed to pass through to infrared detector module 70 is reduced. Following a pulse of blood, the amount of infrared light allowed to pass through to infrared detector module 70 increases.

Infrared optical detector 70 provides a pulsed electronic signal to ASIC controller unit 46 based on this increase and decrease in the amount of infrared light. A heart rate is determined by counting the number of these electronic pulses within a one minute time interval. The predetermined time interval of one minute can easily be changed by reprogramming.

Figure 6:
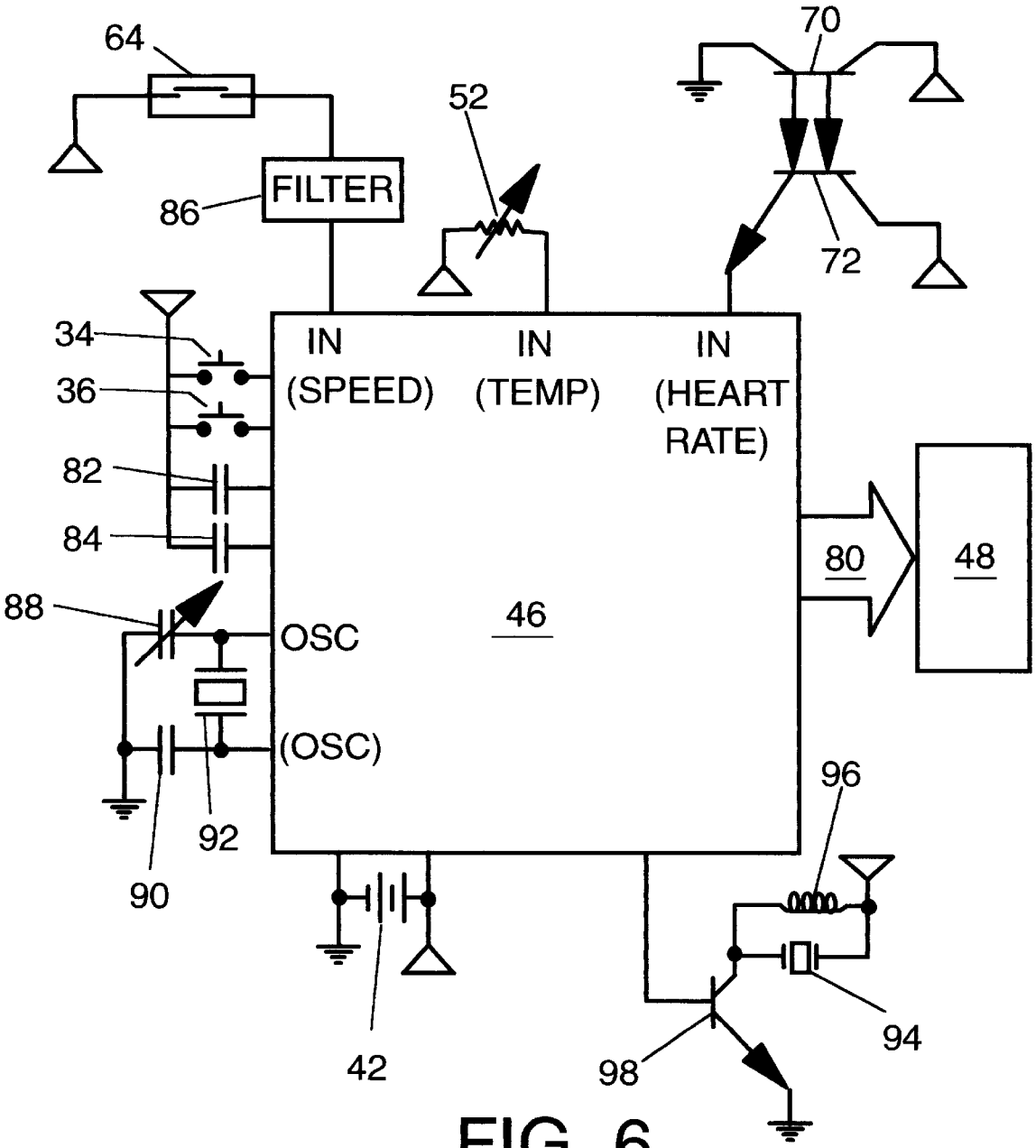

Referring now to FIG. 6, there is shown in schematic form the circuit of the goggle. ASIC controller unit 46 is a commercially available mask-programmable microcomputer chip, having internal microprocessor, accumulators, memory, input and output control circuits, electronic display drive circuits and programmed instruction sets. Such microcomputers are readily available from several sources, but a suitable microcomputer for the present application is part number JT 7598 AS, which is available from Toshiba Electric Company.

Also shown on the FIG. 6 schematic drawing are electronic display 48, magnetic sensor switch 64, battery 42, infrared phototransistor 70, infrared detector module 72, thermistor temperature sensor 52, and switches S1 34 and S2 36 discussed previously. A number of additional circuit elements are present that are well known and normally understood to be part of the operational parts of a digital clock circuit. These are a quartz crystal 92 serving as a time base, an external capacitor C4 90, and an external variable capacitor C3 88 that are connected in circuit with quartz crystal 92, and are connected to pins labeled OSC and (OSC).

Connected to input pin labeled IN (TEMP) on ASIC controller unit 46 is thermistor temperature sensor 52. Thermistor temperature sensor 52 is well known and normally understood to be an operational part of a digital air temperature sensor. Infrared detector module 72 is connected to input pin labeled IN (HEART RATE) on ASIC controller unit 46.

Connected between magnetic sensor switch 64 and an input pin labeled IN (SPEED) on ASIC controller unit 46 is a filter 86 for removing noise and ensuring the desired input signal at each closure of magnetic sensor switch 64.

An alarm/cadence beeper is made up of a piezo electric crystal 94, an inductance coil 96, and a drive transistor 98. An external capacitor C1 82 and an external capacitor C2 84 are combined with other circuit elements inside ASIC controller unit 46 to boost output voltage to drive electronic display 48 through a display bus 80. Display bus 80 represents the electronic and electrical connections between ASIC controller unit 46 and electronic display 48.

Figure 8:
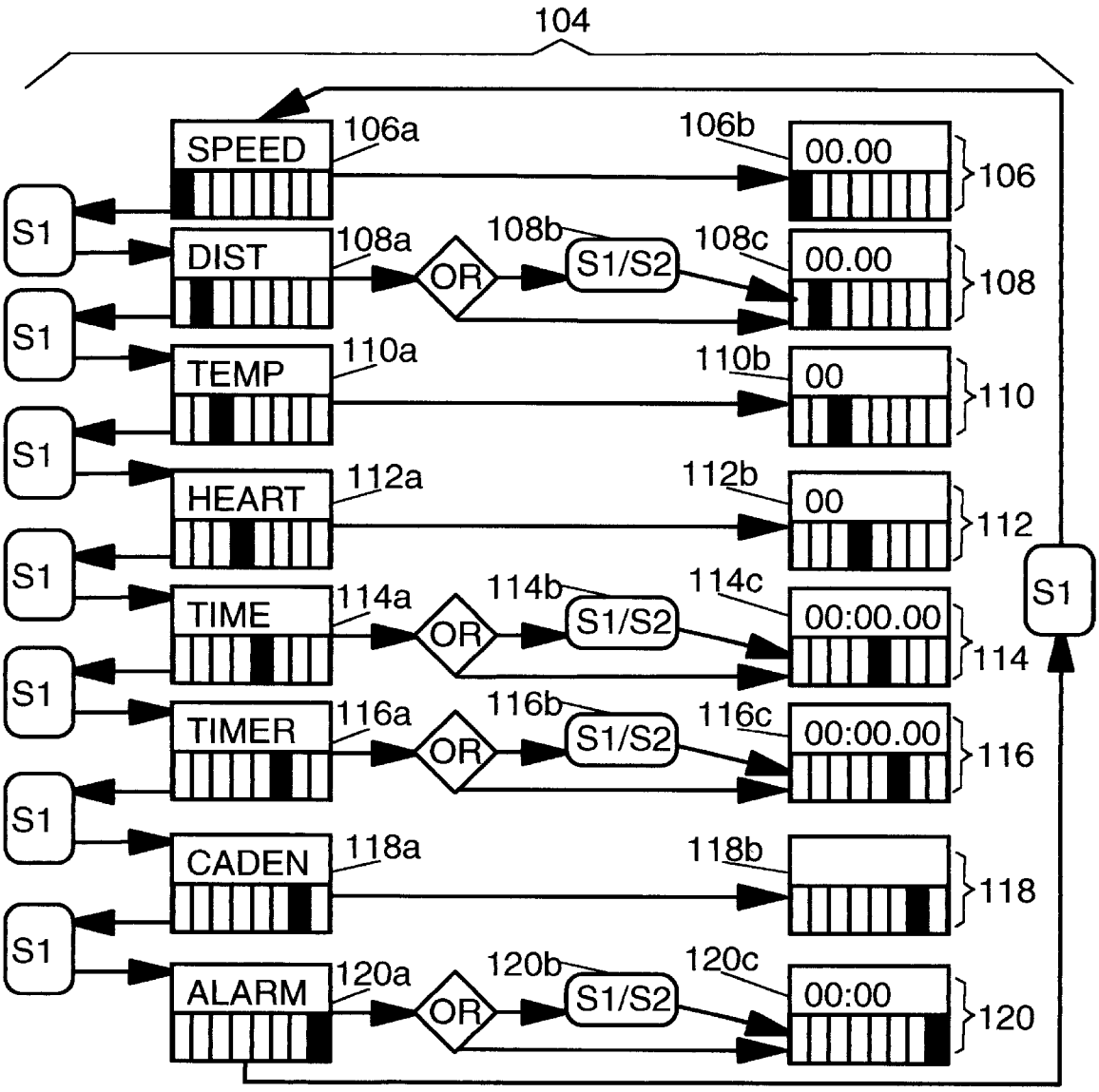

ASIC controller unit 46 is programmed at the time of manufacture to provide the following:

- Various functions associated with a digital clock and timer;
- To receive periodic input signals provided by magnetic sensor switch 64;
- To receive periodic input signals provided by thermistor temperature sensor 52;
- To receive periodic input signals provided by infrared detector module 72;
- To make internal computations of speed, distance, temperature, heart rate, time of day, elapsed time, and cadence;
- To decode and display the results;
- To provide logic for changing between each mode of operation by appropriate actuation of switch S1 34 and switch S2 36 (referred to in detail with reference to FIG. 8).

Conventional programming techniques are used which are within the knowledge of those skilled in the art.

Figure 7:
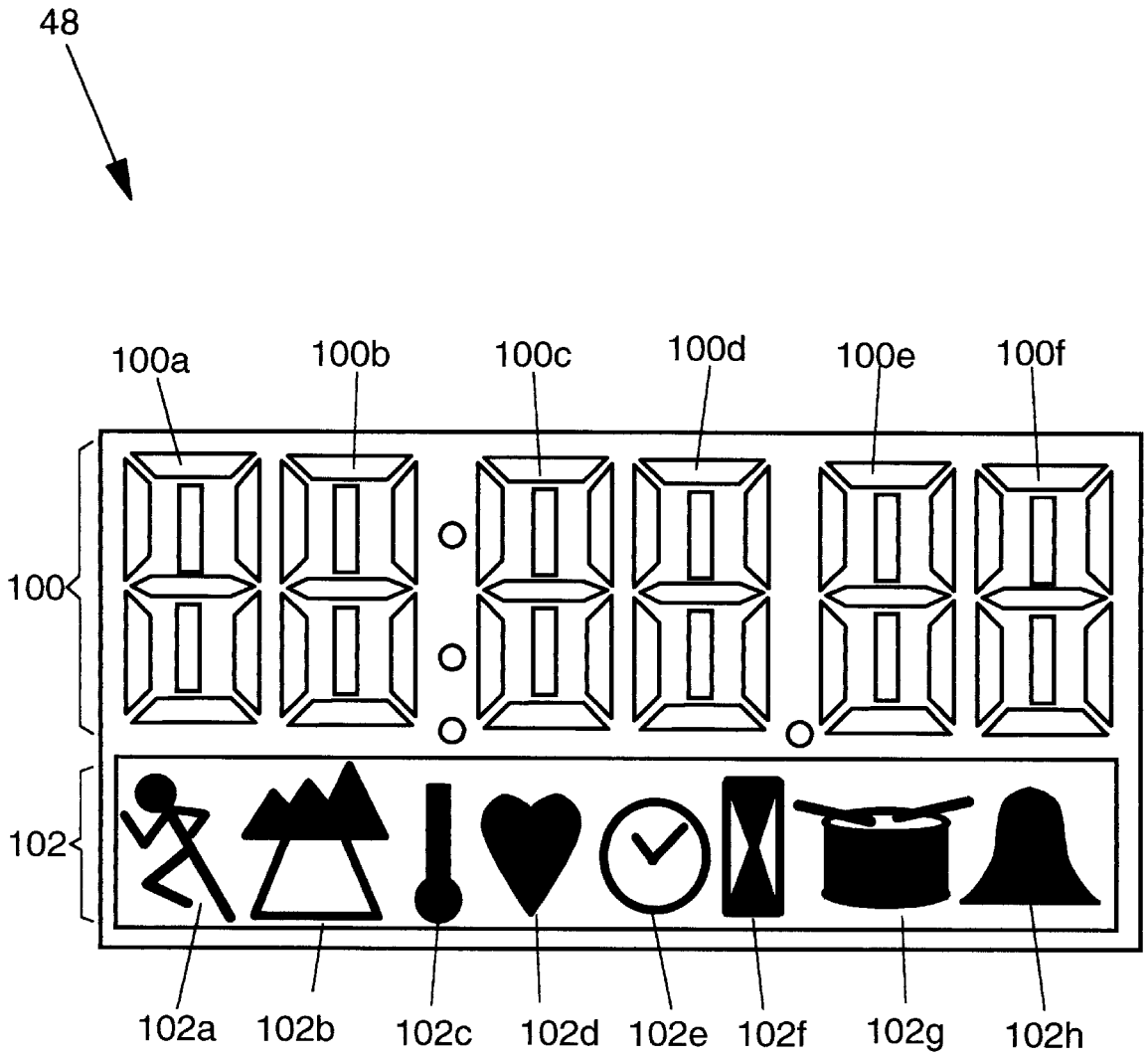

Referring now to FIG. 7 of the drawing, the layout of segments for electronic display 48 used in sports goggle 20 is shown. An upper level of digits 100 has an individually actuatable segment digit 1 100*a*, digit 2 100*b*, digit 3 100*c*, digit 4 100*d*, digit 5 100*e*, and digit 6 100*f*.

A lower level of icons 102 has an individually actuatable speed icon 102*a*, distance icon 102*b*, temperature icon 102*c*, heart rate icon 102*d*, time icon 102*e*, timer icon 102*f*, cadence icon 102*g*, and alarm icon 102*h*. Upper level of digits 100 includes extra segments for providing both numeric display and alpha-numeric messaging.

In FIG. 8 of the drawing, a drawing of an operation mode sequence 104 is shown in schematic form. The rectangles represent what electronic display 48 will show for each mode of operation of ASIC controller unit 46. ASIC controller unit 46 continues to operate under control of a particular subroutine in its internal program until it is placed into another mode.

ASIC controller unit 46 is changed from one mode to another by actuation of switch S1 34. The actuation of switch SI 34 is represented by an "S1" surrounded by an oval in the drawing. Each mode has at least two states of operation, with some modes having additional optional states.

The decision process for the optional states is represented by an "OR" surrounded by a diamond. These optional states are selected by combined actuation of switch S1 34 and switch S2 36. These optional states are represented by an "S1/S2" surrounded by an oval in the drawing.

Although the modes can be sequenced in any desired manner, depending on how ASIC control unit 46 is programmed, the FIG. 8 arrangement shows operation mode sequence 104 having eight separate modes of operation. These include a speed mode 106, a distance mode 108, a temperature mode 110, a heart rate mode 112, a time mode 114, a timer mode 116, a cadence mode 118, and an alarm mode 120.

Repetitive momentary actuation of push button switch S1 34 will cause ASIC control unit 46 to cycle repetitively through modes 106, 108, 110, 112, 114, 116, 118, and 120. Upper level of digits 100 (described previously in reference to FIG. 7) within electronic display 48 displays an alphanumeric description for the selected mode.

Representative alphanumeric descriptions for each mode of operation include a speed message state 106*a*, a distance message state 108*a*, a temperature message state 110*a*, a heart rate message state 112*a*, a time message state 114*a*, a timer message state 116*a*, a cadence message state 118*a*, and an alarm message state 120*a*. Lower level of icons 102 (discussed previously in reference to FIG. 7) within electronic display 48 will simultaneously display the related mode icon.

Speed mode 106 displays speed message state 106*a* for two seconds. Following the two second interval, speed mode 106 enters a speed display state 106*b* and displays a speed reading. In a similar fashion, temperature mode 110 will switch between temperature message state 110*a* and a temperature display state 110*b*. Likewise, heart rate mode 112 will switch between heart rate message state 112*a* and a heart rate display state 112*b*.

Cadence mode 118 displays cadence message state 118*a* for two seconds. Following the two second interval, cadence mode 118 will enter a cadence display state 118*b*. Cadence display state 118*b* displays only cadence icon 102*g* within electronic display 48. The alarm/cadence beeper (discussed previously in reference to FIG. 6) will emit a beep each second to produce an audible beat. Cadence icon 102*g* will visually turn on and off each second in response to the audible beat or cadence.

Distance mode 108 displays distance message state 108*a* for two seconds. Following the two second interval, speed mode 108 enters a distance display state 108*c* and displays a distance reading. If switch S1 34 and switch S2 36 are pressed simultaneously within the two second interval, distance accumulators in ASIC controller unit 46 will be reset to zero. This is represented by a reset distance state 108*b*.

Time mode 114 displays time message state 114*a* for two seconds. Following the two second interval, time mode 114 enters a time display state 114*c* and displays a time reading. Time, including hours, minutes, and seconds can be set by simultaneously pressing switch S1 34 and switch S2 36 during the two second interval. This is represented by a set time state 114*b*.

Alarm mode 120 uses the same methodology as time mode 114. Alarm message state 120*a* will display for two seconds, followed by a display of an alarm display state 120*c*. Simultaneous actuation of switch S1 34 and switch S2 36 within the two second interval will set an alarm time, represented by a set alarm state 120*b*.

Timer mode 116 displays timer message state 116*a* for two seconds. Following the two second interval, timer mode 116 enters a timer display state 116*c* and displays a timer reading. If switch S1 34 and switch S2 36 are pressed simultaneously within the two second interval, timer accumulators in ASIC controller unit 46 will be reset to zero. This is represented by a reset timer state 116*b*.

The pre-defined time delay of two seconds associated with each mode of operation can easily be changed by reprogramming. The number of modes shown, and the sequence of modes is purely a matter of choice, and require only routine programming of ASIC control unit 46.

Figure 9:
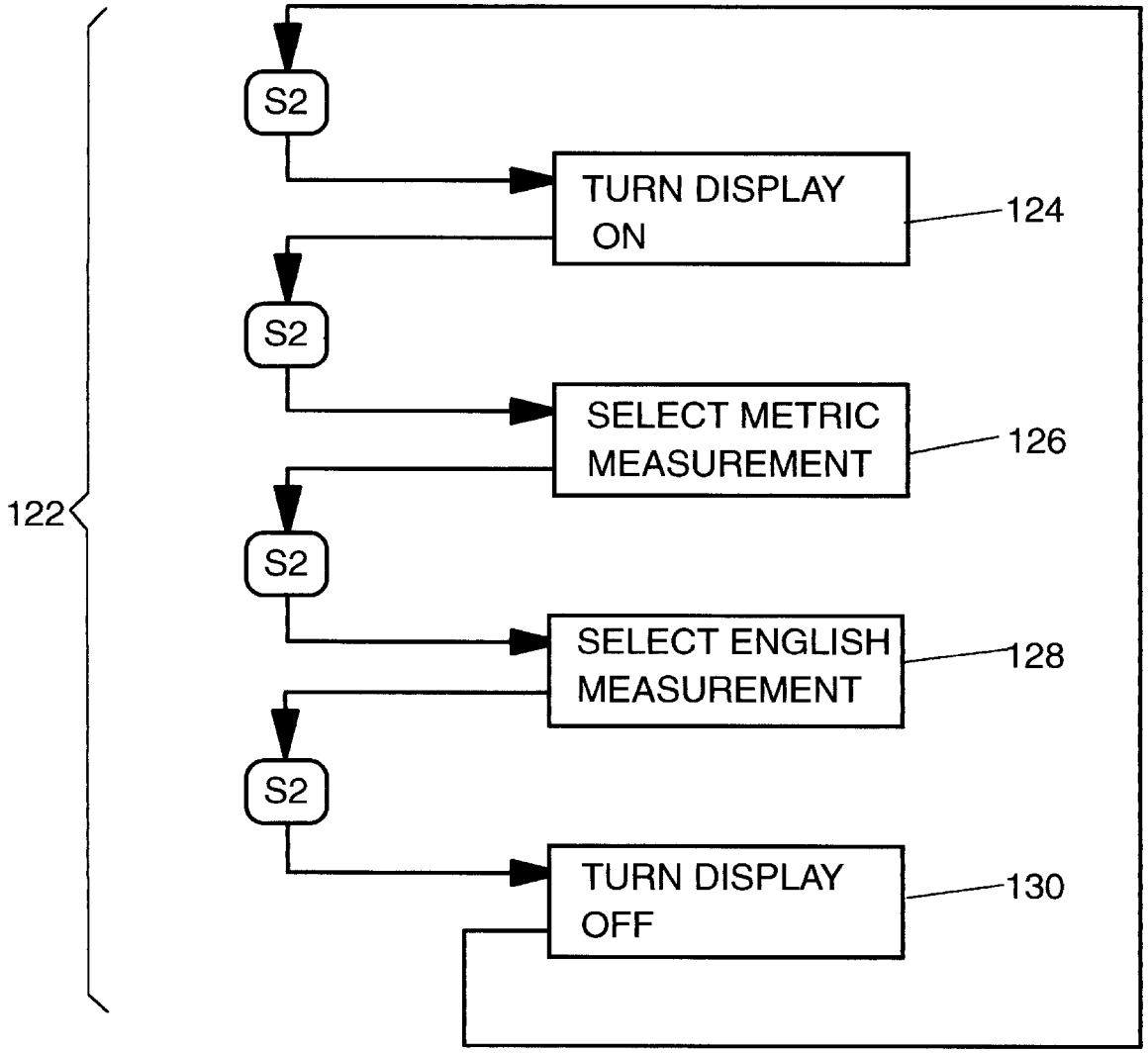

In FIG. 9 of the drawing, a power/measurement mode sequence 122 is shown in schematic form. Electronic display 48 can be turned on and off to conserve battery power. Additionally, speed mode 106, distance mode 108, and temperature mode 110 (discussed previously in reference to FIG. 8) offer both English and metric measurements.

Each rectangle represents one of these modes of operation within ASIC controller unit 46. These modes include a turn display on mode 124, a metric measurement mode 126, an English measurement mode 128, and a turn off display mode 130. ASIC controller unit 46 will continue to operate under control of a particular subroutine in its internal program until it is placed into another mode. Actuation of switch S2 36 will cause ASIC control unit 46 to switch to the next mode. The actuation of switch S2 36 is represented by the ovals in the drawing.

Initial actuation of switch S2 36 will cycle ASIC control unit 46 to turn display on mode 124, providing power to electronic display 48. Speed mode 106, distance mode 108, and temperature mode 110 will initially default to the English measurement system.

Repetitive momentary actuation of switch s2 36 will cause ASIC control unit 46 to repetitively cycle through modes 124, 126, 128, and 130. Turn display off mode 130 will turn off power to electronic display 48. The number of modes shown, and the sequence of modes is purely a matter of choice, and require only routine programming of ASIC control unit 46.

Figure 10:
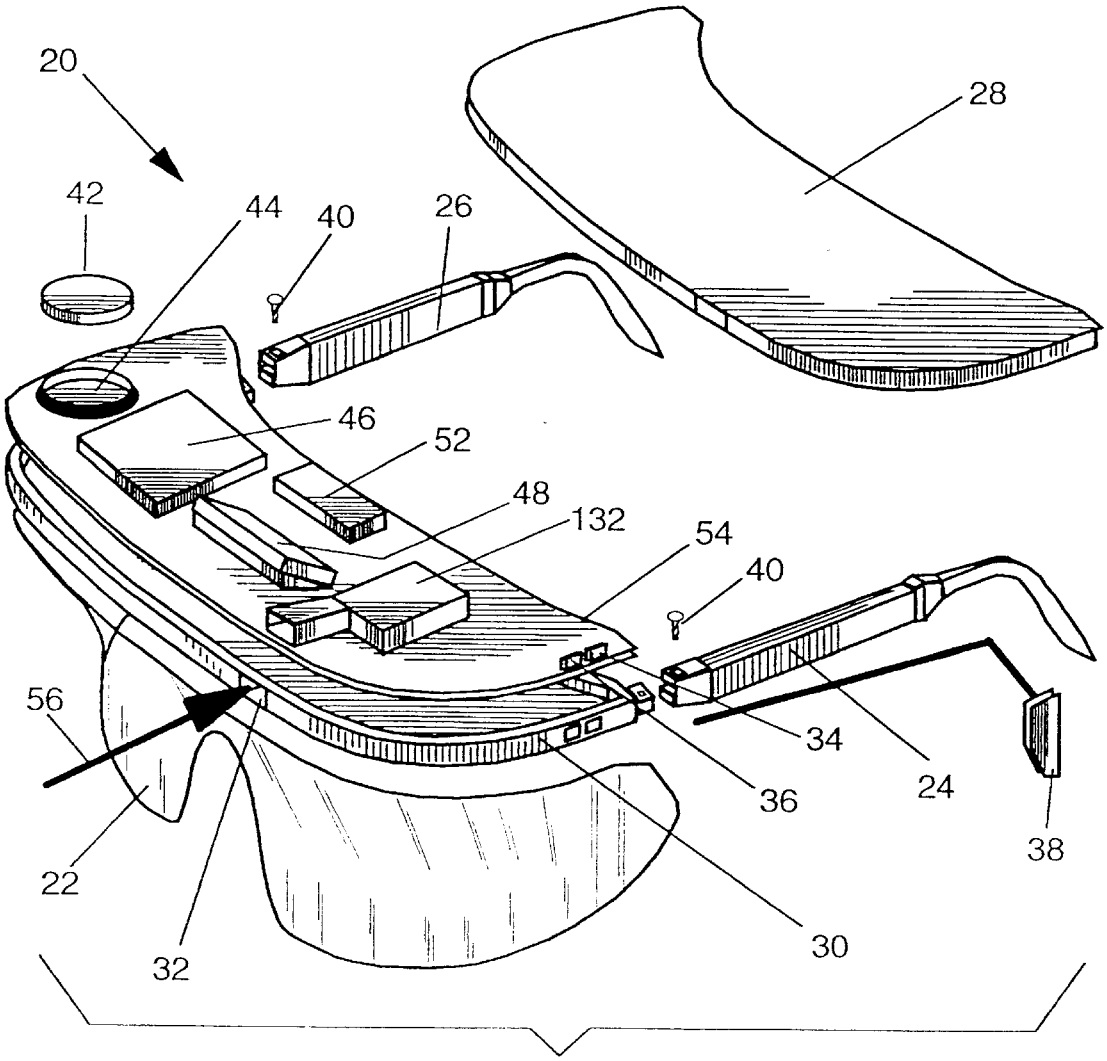

Referring now to FIG. 10, there is shown a second embodiment using an alternative system of measuring air flow. A mass airflow sensor 132 is mounted inside goggle casing base 30. Mass airflow sensor 132 operates on the theory of heat transfer due to mass airflow directed across the surface of a sensing element. Output voltage varies in proportion to the flow of air through the inlet and outlet ports of mass airflow sensor 132.

The output voltage is an analog variable signal that is converted by ASIC control unit 46 into an appropriate speed calculation. A suitable commercial mass airflow sensor is made by Honeywell Micro Switch Division under the designation AWM3300V. Air inlet 32 allows air stream 56 to pass through the surrounding wall of goggle casing base 30 and into mass airflow sensor 132.

Figure 11:
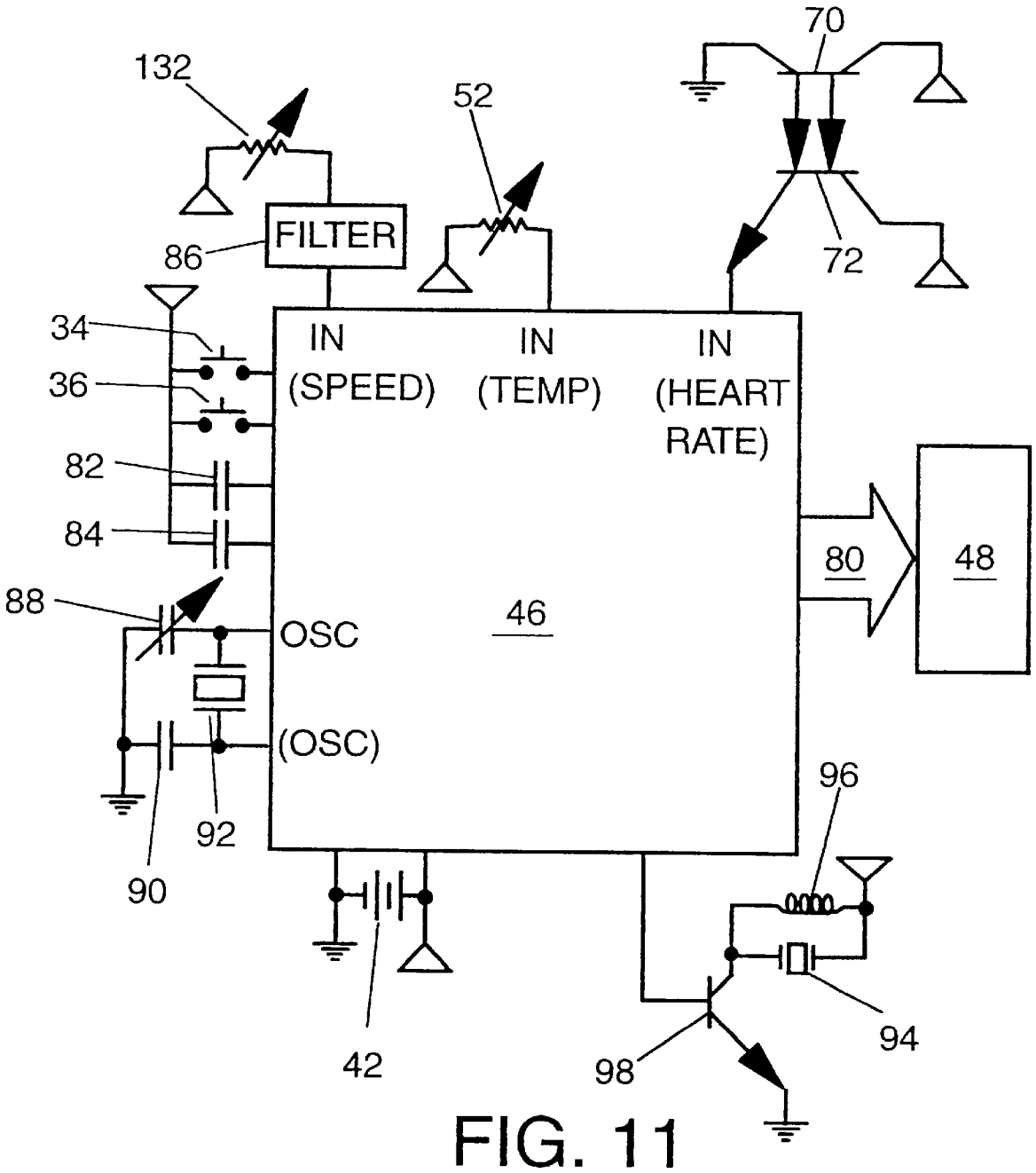

Referring now to FIG. 11, there is shown in schematic form the circuit of the goggle using mass airflow sensor 132. All circuitry is identical to the circuitry discussed previously in reference to FIG. 6, except that mass airflow sensor 132 is connected to input pin labeled IN (SPEED) rather than magnetic sensor switch 64. All other circuitry is unchanged in reference to previously discussed FIG. 6.

It will be understood that the modes of operation for the second embodiment using mass airflow sensor 132 are identical to the modes of operation outlined previously in FIGS. 8 and 9. It will also be understood that the flow of air into mass airflow sensor 132 is identical to the air flow outlined previously in reference to FIG. 3.

Figure 12:
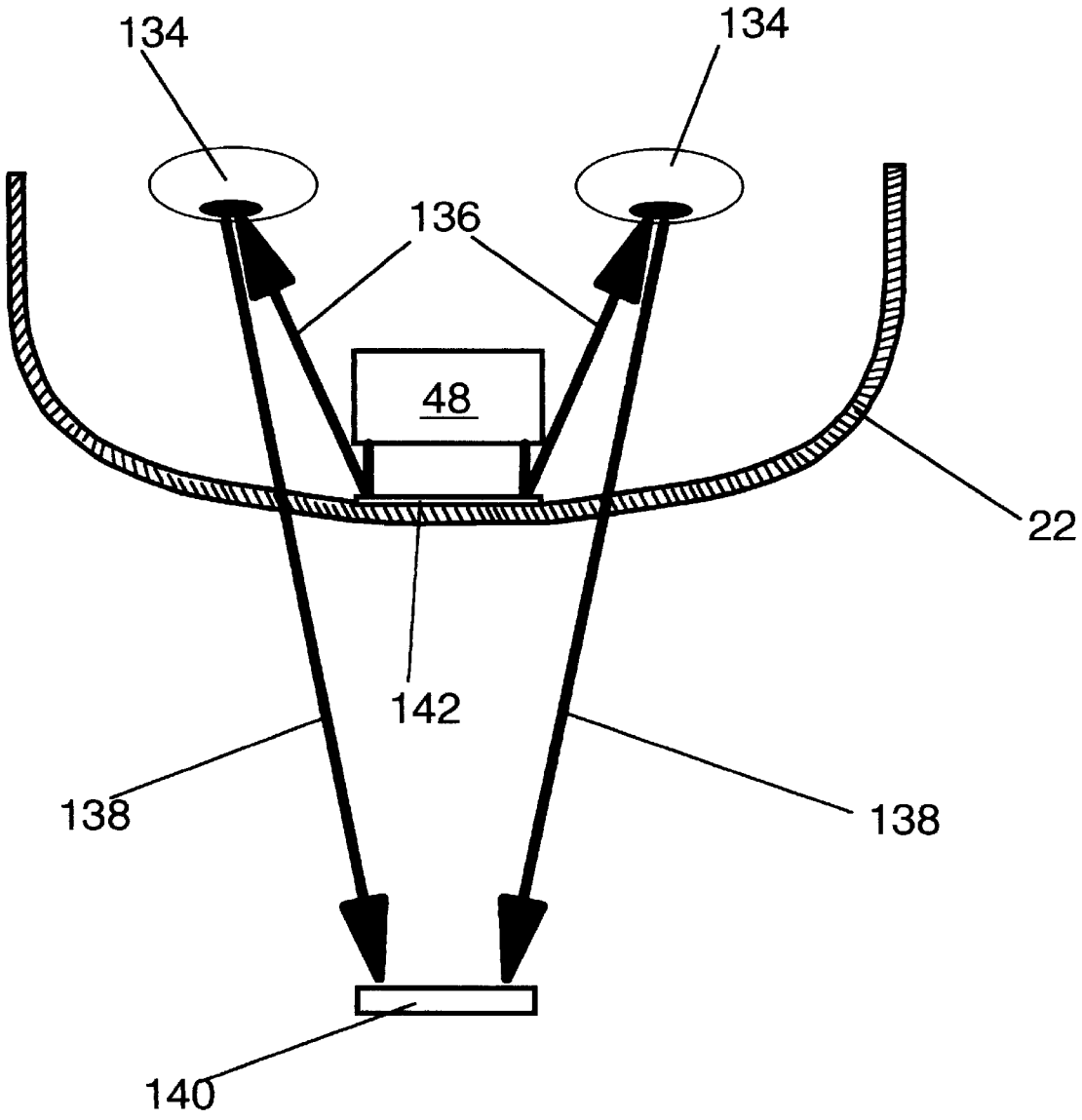
Figure 13:
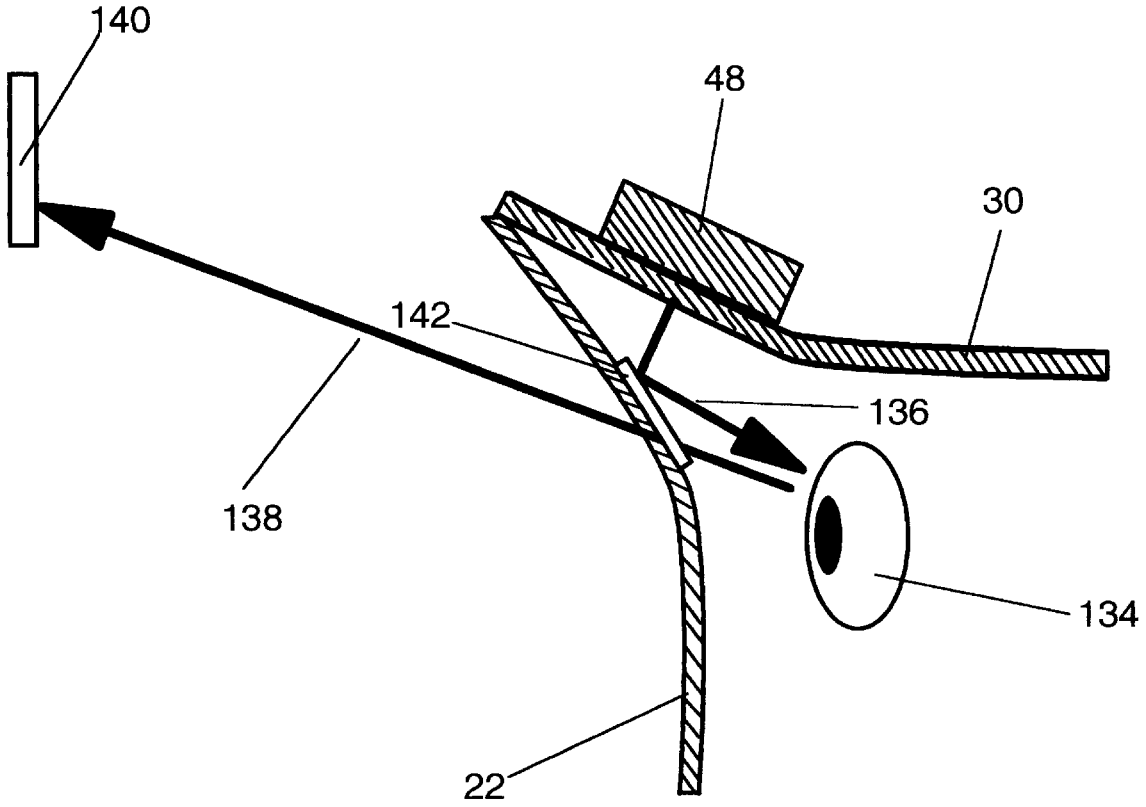

Referring now to FIGS. 12 and 13, the theory of image projection is shown in schematic form. A radiant light wave 136 is emitted by electronic display 48. Radiant light wave 136 is reflected on the partially reflective inside surface of goggle lens 22 as a reflected image 142. A user's eye 134 perceives reflected image 142 on transparent goggle lens 22 to be a projected image 140 in a user's line of sight 138.

Figure 14:
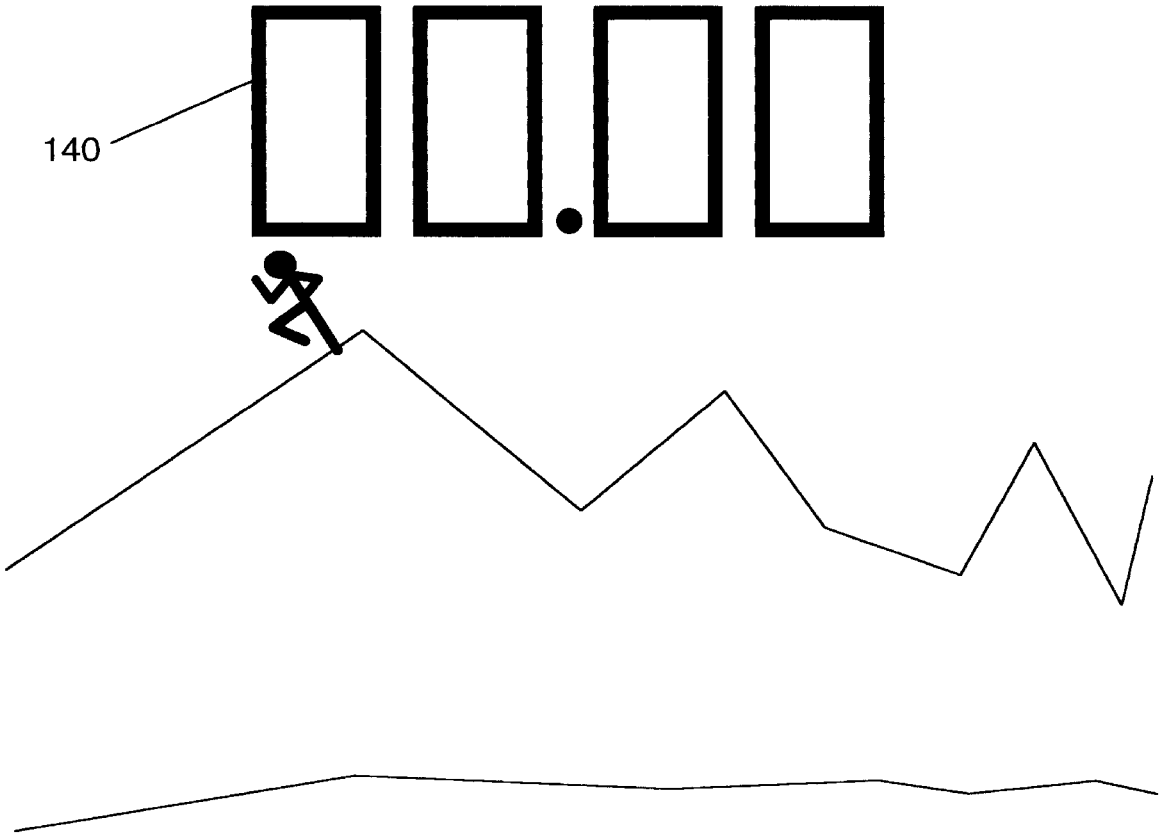

Referring now to FIG. 14, a representative display of projected image 140 as seen from user's eye 134 (not shown) is shown. Reflected image 142 appears to float directly in front of the viewer as projected image 140 at a two-foot focal distance. This focal distance is only a matter of choice, and can easily be changed at time of construction. The positioning of projected image 140 towards the top of goggle lens 22 provides the user with a clear, unobstructed forward field of vision.

OPERATION

Accordingly, the operation of the preferred embodiment of the athletic activity monitoring goggle in the present invention should be apparent from the following description. Referring now to FIGS. 1 and 2, sports goggle 20 is secured to a user's head with left ear piece 24 and right ear piece 26. Pulse sensor assembly 38 is clipped to the ear lobe of the user. When electronic display 48 is not turned on, sports goggle 20 may be used as a normal pair of goggles.

When using sports goggle 20 as an athletic monitoring device, power is provided to electronic display 48 by pressing switch S2 36. The unit of measurement for the speed, distance, and temperature modes may be changed from English to metric to English by successive actuation of switch S2 36. When the user is finished using sports goggle 20 as an athletic monitoring device, electronic display 48 is turned off by pressing switch S2 36.

Referring now to FIGS. 3 and 4, as the user progresses in a forward direction, air stream 56 will flow through air inlet 32 into impeller assembly 50. The flow of air stream 56 will cause impeller fan 58 to rotate on its axis, generating a pulsed electrical signal that is representative of movement and that corresponds to the user's speed.

Referring now to FIG. 14, user's eye 134 (not shown) will perceive reflected image 142 to be represented as projected image 140 at a two-foot focal distance. Readings of speed, distance, temperature, heart rate, time, timer, cadence, and alarm will be projected in front of the user. These readings can be changed by successive actuation of switches S1 34 and S2 36 (not shown).

Reference is now made to the second embodiment of the athletic activity monitoring goggle using mass airflow sensor 132. As the user progresses in a forward direction, air stream 56 (FIGS. 3 and 10) will flow through air inlet 32 into mass airflow sensor 132. The flow of air stream 56 will cause mass airflow sensor 132 to generate a proportional electrical signal representative of movement. It will be understood that all other operation of sports goggle 20 is identical to that outlined above for the preferred embodiment.

SUMMARY, RAMIFICATIONS AND SCOPE

Accordingly, the reader will see that the athletic activity monitoring goggle of this invention can be used to provide an athlete with a continuous flow of performance related information. This information includes speed, distance traveled, temperature, heart rate, time of day, elapsed time, cadence, and a time based alarm. This uninterrupted flow of information allows the athlete to easily monitor and adjust their athletic performance. Furthermore, the athletic activity monitoring goggle has additional advantages in that

- the informational display is simple to read and comprehend;
- it is similar in size and shape to eye glasses, and will not significantly interfere with or restrict the movement of the athlete;
- it is simple to use and operate;
- the electronic and plastic construction make it capable of withstanding the impacts and shocks associated with athletic activity; and
- it is inexpensive and simple to manufacture.

It will be apparent from the foregoing description that the goggle of the invention provides a safe, economic, and highly reliable method for monitoring an athlete's performance.

Although the description above contains many specificities, these should not be construed as limiting the scope of the invention but as merely providing illustrations of some of the presently preferred embodiments of this invention. For example, the goggle can have other shapes, sizes, and styles. Micro impulse radar (MIR) or ultrasonic transmitter/receiver devices may be used as movement sensors. A radio receiver device may be used to receive speed and other information from remote devices. The same unit, in its preferred embodiment, can easily be adapted to other uses. Many modifications and variations are possible considering the above teaching.

Thus the scope of the invention should be determined by the appended claims and their legal equivalents, rather than by the examples given.

I claim:

1. A head mounted athletic activity monitoring device, said device comprising:

- a housing having a predetermined cross-sectional shape and an internal chamber with a mounting surface;
- an attaching means functioning to attach said housing to a user's head;
- a transparent material having a predetermined cross-sectional shape and an underside, said transparent material being partially reflective in nature;
- a securing means functioning to secure said transparent material to said housing;
- an electro-optical projection means functioning to project an image on said underside of said transparent material, said electro-optical projection means mounted on said mounting surface;
- a battery powered microprocessor circuit means electrically connected to said electro-optical projection means, said microprocessor circuit means mounted on said mounting surface; and
- a movement sensing means electrically connected to said microprocessor circuit means, said movement sensing means functioning to provide an electronic output representative of movement which corresponds to the user's speed, said movement sensing means mounted on said mounting surface, thereby enabling the user to visually perceive his speed.

2. The device of claim 1 wherein said movement sensing means further comprises a rotatably mounted impeller.

3. The device of claim 2 wherein said movement sensing means further comprises a mass airflow sensor.

4. The device of claim 3 further comprising a heart rate sensing means, said heart rate sensing means functioning to provide an electronic output representative of heart rate, said heart rate sensing means electrically connected to said microprocessor circuit means, whereby a heart rate image is projected on said transparent material.

5. The device of claim 4 further comprising a time-keeping circuit in said mocroprocessor circuit means.

6. The device of claim 5 further comprising an air temperature sensing means, said air temperature sensing means providing an electronic output representative of air temperature, said air temperature sensing means electrically connected to said microprocessor circuit means, whereby an air temperature image is projected on said transparent material.

7. The device of claim 3 further comprising a distance accumulator means in said microprocessor circuit means for calculating distance traveled.

8. The device of claim 3 further comprising a mode switching means functioning to switch between at least two modes, the first of said modes being a power on mode, the second of said modes being a power off mode, said mode switching means electrically connected to said microprocessor means.

9. The device of claim 8 further comprising memory means in said microprocessor circuit means functioning to allow the user to select speed information at user defined time intervals to be stored for later access and retrieval.

10. The device of claim 9 further comprising memory means in said microprocessor circuit means for allowing the user to select heart rate information at user defined time intervals to be stored for later access and retrieval.

11. A head mounted athletic activity monitoring device, said device comprising:

a housing having a predetermined cross-sectional shape and an internal chamber with a mounting surface;

an attaching means functioning to attach said housing to a user's head;

a transparent material having a predetermined cross-sectional shape and an underside, said transparent material being partially reflective in nature;

a securing means functioning to secure said transparent material to said housing;

an electro-optical projection means for projecting an image on said underside of said transparent material, said electro-optical projection means mounted on said mounting surface;

a battery powered microprocessor circuit means electrically connected to said electro-optical projection means, said microprocessor circuit means mounted on said mounting surface;

a movement sensing means electrically connected to said microprocessor circuit means, said movement sensing means functioning to provide an electronic output representative of movement, said movement sensing means mounted on said mounting surface;

a heart rate sensing means, said heart rate sensing means functioning to provide an electronic output representative of heart rate, said heart rate sensing means electrically connected to said microprocessor circuit means whereby a heart rate image is projected on said transparent material;

a time-keeping circuit in said microprocessor circuit means; and an air temperature sensing means, said air temperature sensing means functioning to provide an electronic output representative of air temperature, said air temperature sensing means electrically connected to said microprocessor circuit means, said air temperature sensing means mounted on said mounting surface, whereby an air temperature image is projected on said transparent material.

12. The device of claim 11 further comprising a mode switching means for switching between at least ten modes, the first of said modes being a power on mode, the second of said modes being a speed mode, the third of said modes being a distance mode, the fourth of said modes being a temperature mode, the fifth of said modes being a heart rate mode, the sixth of said modes being a time mode, the seventh of said modes being a timer mode, the eighth of said modes being a cadence mode, the ninth of said modes being an alarm mode, and the tenth of said modes being a power off mode, said mode switching means electrically connected to said microprocessor means.

13. The device of claim 12 further comprising a distance accumulator means functioning to calculate distance traveled in said microprocessor circuit means.

14. The device of claim 13 further comprising memory means in said mocroprocessor circuit means functioning to allow the user to select heart rate information at user defined time intervals to be stored for later access and retrieval.

15. The device of claim 14 further comprising memory means in said mocroprocessor circuit means functioning to allow the user to select speed information at user defined time intervals to be stored for later access and retrieval.

16. The device of claim 15 wherein said movement sensing means further comprises a rotatably mounted impeller.

17. The device of claim 16 wherein said movement sensing means further comprises a mass airflow sensor.

18. A head mounted athletic activity monitoring device, said device comprising:

a goggle like housing having a semi-transparent lens, said lens having an underside;

an electrical circuit, said circuit comprising an electronic image projection means functioning to project an image on said underside of said lens, a microprocessor means functioning to control said circuit, an electrical power means functioning to power said circuit, a movement sensing means functioning to sense movement, a heart rate sensing means functioning to sense heart rate, a time-keeping circuit, and an air temperature sensing means; and a mode switching means functioning to switch between at least ten modes, the first of said modes being a power on mode, the second of said modes being a speed mode, the third of said modes being a distance mode, the fourth of said modes being a temperature mode, the fifth of said modes being a heart rate mode, the sixth of said modes being a time mode, the seventh of said modes being a timer mode, the eighth of said modes being a cadence mode, the ninth of said modes being an alarm mode, and the tenth of said modes being a power off mode, said mode switching means electrically connected to said electrical circuit.

19. The device of claim 18 wherein said movement sensing means further comprises a rotatably mounted impeller.

20. The device of claim 19 wherein said movement sensing means further comprises a mass airflow sensor.

* * * * *